US008787525B2

(12) United States Patent
Komoto et al.

(10) Patent No.: US 8,787,525 B2
(45) Date of Patent: Jul. 22, 2014

(54) X-RAY MONOCHROMATOR, METHOD OF MANUFACTURING THE SAME AND X-RAY SPECTROMETER

(75) Inventors: Atsushi Komoto, Moriya (JP); Hirokatsu Miyata, Hadano (JP); Wataru Kubo, Inagi (JP)

(73) Assignee: Canon Kabushiki Kaisha, Tokyo (JP)

( * ) Notice: Subject to any disclaimer, the term of this patent is extended or adjusted under 35 U.S.C. 154(b) by 551 days.

(21) Appl. No.: 12/916,025

(22) Filed: Oct. 29, 2010

(65) Prior Publication Data

US 2011/0129065 A1 Jun. 2, 2011

(30) Foreign Application Priority Data

Nov. 30, 2009 (JP) ..... 2009-272882
Sep. 9, 2010 (JP) ..... 2010-202048

(51) Int. Cl.
*G21K 1/06* (2006.01)
*B05D 5/06* (2006.01)

(52) U.S. Cl.
USPC ..... 378/84; 427/160

(58) Field of Classification Search
USPC ..... 378/70, 71, 78, 79, 84, 87, 90, 85
See application file for complete search history.

(56) References Cited

U.S. PATENT DOCUMENTS

| | | | | |
|---|---|---|---|---|
| 5,444,242 | A * | 8/1995 | Larson et al. | 250/305 |
| 5,528,654 | A * | 6/1996 | Niibe et al. | 378/84 |
| 6,498,830 | B2 * | 12/2002 | Wittry | 378/84 |
| 7,618,703 | B2 | 11/2009 | Miyata et al. | 428/312.2 |
| 2003/0080292 | A1 * | 5/2003 | Watson et al. | 250/306 |
| 2005/0043184 | A1 | 2/2005 | McCleskey et al. | 505/100 |
| 2005/0117194 | A1 * | 6/2005 | Kim et al. | 359/273 |
| 2007/0023289 | A1 | 2/2007 | Miyata et al. | 204/515 |

FOREIGN PATENT DOCUMENTS

| | | |
|---|---|---|
| EP | 626700 | 11/1994 |
| EP | 1001434 | 5/2000 |
| JP | 63-94200 | 4/1988 |
| JP | H08-262199 | 10/1996 |
| JP | 2002-214165 | 7/2002 |
| JP | 2005-246369 | 9/2005 |
| JP | 2005-272532 | 10/2005 |
| JP | 2006-327853 | 12/2006 |
| WO | WO 2004/015167 A | 2/2004 |
| WO | WO 2005/014480 A | 2/2005 |
| WO | WO 2010/076429 | 7/2010 |

OTHER PUBLICATIONS

Extended European Search Report dated Jan. 9, 2012, issued in counterpart EP 10014516.8.
XP002628597—abstract of F Iskander et al., "Silica Films Containing Ordered Pores Prepared by Dip Coating of Silica Nanoparticles and Polystyrene Beads Colloidal Mixture", *Jour. of Sol-Gel Sci and Techn.* (Jan. 1, 2004).

* cited by examiner

*Primary Examiner* — Allen C. Ho
*Assistant Examiner* — Danielle Fox
(74) *Attorney, Agent, or Firm* — Fitzpatrick, Cella, Harper & Scinto

(57) ABSTRACT

An X-ray monochromator including: a substrate having a concave surface; and an inorganic oxide film formed on the concave surface and having a plurality of pores, in which the plurality of pores of the inorganic oxide film being laid periodically in a stacked manner in the normal directions of the concave surface, and in which the plurality of pores being cylindrical is provided. The X-ray monochromator shows an excellent X-ray spectroscopic performance.

5 Claims, 5 Drawing Sheets

X-RAY MONOCHROMATOR, METHOD OF MANUFACTURING THE SAME AND X-RAY SPECTROMETER

BACKGROUND OF THE INVENTION

1. Field of the Invention

The present invention relates to an X-ray monochromator, a method of manufacturing the same and an X-ray spectrometer using such an X-ray monochromator.

2. Description of the Related Art

An X-ray monochromator is employed in an X-ray spectrometer having a configuration as illustrated in FIG. 6 of the accompanying drawings. Referring to FIG. 6, an X-ray monochromator 110, an X-ray source 12 and an X-ray detector 13 are arranged on a Rowland circle 14 having a radius R with its center located at point A. The X-ray source 12 is, for example, a sample that generates fluorescent X-rays. X-rays (incident X-rays 16) that are irradiated from the X-ray source 12 and that include a variety of wavelength components are reflected at different positions of the X-ray monochromator 110 and reflected X-rays 17 are focused at the detection surface of the X-ray detector 13, where the intensity of focused X-rays is observed. A phenomenon of diffraction is utilized for the reflection of X-rays and only X-rays of specific wavelengths that satisfy the Bragg condition (formula 1) shown below are observed by the X-ray detector 13. The intensity of X-rays of each wavelength that corresponds to the formula 1 can be measured by moving the X-ray source 12 and the X-ray detector 13 on the Rowland circle 14 and shifting the incident angle θ at reflection point C.

$$2d \sin \theta = n\lambda \qquad \text{(Formula 1)}$$

(where d: structural period, θ: incident angle, angle of diffraction (Bragg angle), n: degree of diffraction, λ: X-ray wavelength).

The X-ray monochromator 110 has a structural periodicity directed to point B at each reflection position thereof so as to satisfy the requirement of the formula 1, the structural period being d in the formula 1. Namely, the X-ray monochromator 110 is formed by using a member that is curved with a radius of curvature equal to the diameter (2R) of the Rowland circle 14 and made of a material that shows a periodicity in the normal directions of the curved surface.

Additionally, the X-ray monochromator 110 preferably has a surface profile stretching along the Rowland circle 14 so that reflected X-rays 17 are focused at the position of the X-ray detector 13. A monochromator arranged in such a way is referred to as Johansson monochromator. However, Johann monochromators having a surface profile stretching along a circle 15 with a radius equal to the diameter (2R) of the Rowland circle as illustrated in FIG. 6 are often employed.

When the wavelengths of X-rays are relatively long, artificial multilayer film mainly made of an inorganic material and having a structural period of several nanometers is often selected as structurally periodic material to be used for an X-ray monochromator from the viewpoint of easiness of modifying the structural period. A material having a low electron density such as an organic material for artificial multilayer film in order to improve the spectroscopic performance of X-rays can be used. Japanese Patent Application Laid-Open No. S63-94200 discloses an X-ray monochromator using clay having a layered structure and including organic cations in layered spaces and mica minerals as structurally periodic material.

On the other hand, Japanese Patent Application Laid-Open No. 2005-246369 (which corresponds to U.S. Pat. No. 7,618,703) discloses a porous film having a periodic structure formed via self-assembly of molecules and an application thereof to X-ray optical elements. The disclosed porous film shows a symmetric reflection plane that is directed in a same direction over the entire film and has an axis of rotation (n=6). X-ray diffractions in in-plane directions of such a porous film attributable to the symmetry of the film are applied to X-ray devices. A splitter for which X-rays are made to enter such a porous film on the condition of total reflection so that the splitter separates totally reflected X-rays from X-rays diffracted in-plane and a modulator utilizing that the in-plane intensity of diffracted X-rays changes as a function of the direction of X-rays entering such a porous film have been reported.

SUMMARY OF THE INVENTION

However, the inventions of the above listed patent literatures have problems and require improvements. An X-ray monochromator disclosed in Japanese Patent Application Laid-Open No. S63-94200 can sometimes show a limitative spectroscopic performance of X-rays because the X-ray monochromator employs an organic substance for a layer having a low electron density. A material having an electron density lower than an organic substance is required to improve the X-ray spectroscopic performance.

On the other hand, it is very difficult to form a porous film disclosed in Japanese Patent Application Laid-Open No. 2005-246369 on a curved surface. A so-called rubbing process of rubbing a polymer layer formed on a substrate in a single direction is needed to form such a porous film. However, it is difficult to uniformly execute a rubbing process on a curved surface such as a curved surface of an X-ray monochromator and hence it is difficult to apply a porous film of Japanese Patent Application Laid-Open No. 2005-246369 to an X-ray monochromator.

In view of the above-identified technical background, it is therefore the object of the present invention to provide an X-ray monochromator showing an excellent X-ray spectroscopic performance. In an aspect of the present invention, there is provided an X-ray monochromator including: a substrate having a concave surface; and an inorganic oxide film formed on the concave surface and having a plurality of pores, in which the plurality of pores of the inorganic oxide film are laid periodically in a stacked manner in the normal directions of the concave surface, and in which the plurality of pores are cylindrical.

Further features of the present invention will become apparent from the following description of exemplary embodiments with reference to the attached drawings.

DESCRIPTION OF THE EMBODIMENTS

Figure 1:
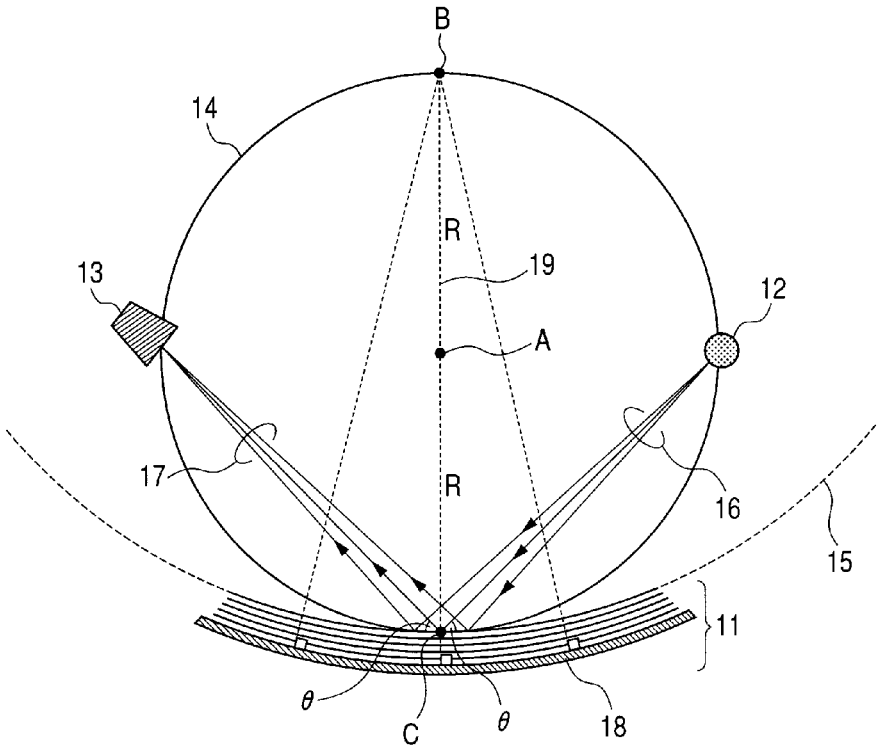
FIG. 1 is a schematic illustration of an X-ray monochromator and an X-ray spectrometer according to the present invention.

Now, preferred embodiments of the present invention will be described below by referring to the accompanying drawings.

As a result of intensive research efforts, the inventors of the present invention found that an X-ray monochromator showing an X-ray spectroscopic performance than ever and an X-ray spectrometer including such an X-ray monochromator can be provided by using, a porous inorganic oxide film having a plurality of cylindrical pores, or a porous inorganic oxide film having a plurality of spherical pores showing a local porous structure with different symmetric reflection planes facing to directions that are different from each other.

An embodiment of X-ray monochromator and that of X-ray spectrometer according to the present invention will be described by referring to FIG. 1. The X-ray monochromator 11 of this embodiment is formed on a concave surface of a substrate 18 by using a porous inorganic oxide film. The concave surface is curved with a radius of curvature equal to the diameter of a Rowland circle. The porous inorganic oxide film of the X-ray monochromator has structural periods in the normal directions 19 of the concave surface of the substrate 18 (to be referred to as structural periods in the normal directions hereinafter). A Rowland circle refers to a circle 14 illustrated in FIG. 1. In other words, it is a circle on which an X-ray source 12, an X-ray detector 13 and an X-ray monochromator 11 are arranged. The X-ray source may be a sample that generates fluorescent X-rays.

The X-ray monochromator of this embodiment is formed by using a porous inorganic oxide film that is characterized by containing air having an electron density much lower than organic substances and forming a periodic structure. For this reason, the conditions on which X-ray diffraction (reflection) takes place, or the incident angle of X-rays and the wavelength range of X-rays, are narrowed according to Darwin-Prins formula so that the wavelength resolution of X-rays can be improved.

The porous inorganic oxide film of this embodiment is prepared by applying a precursor reactive solution onto the top surface of the substrate and by way of a reaction. Therefore, the smallest arrangement for forming the film including molecules or atoms and then the porous inorganic oxide film becomes very flat and smooth. From this point of view, the present invention can provide an X-ray monochromator having an excellent X-ray wavelength resolution.

Figure 5A:
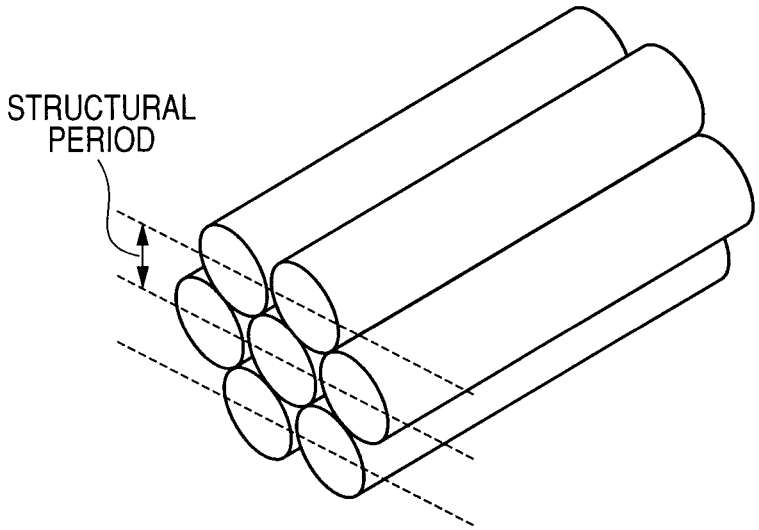
FIG. 5A is a schematic illustration of a porous film having cylindrical pores to be used in an embodiment of the present invention.
Figure 5B:
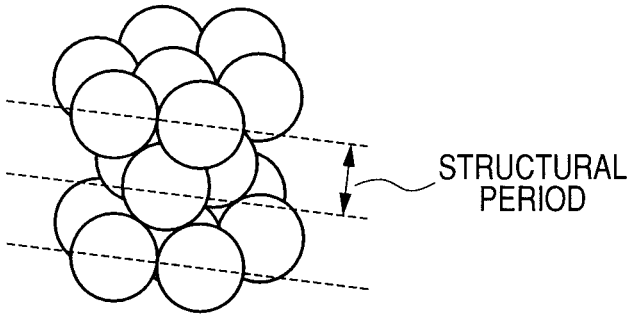
FIG. 5B is a schematic illustration of a porous film having spherical pores to be used in an embodiment of the present invention.
Figure 6:
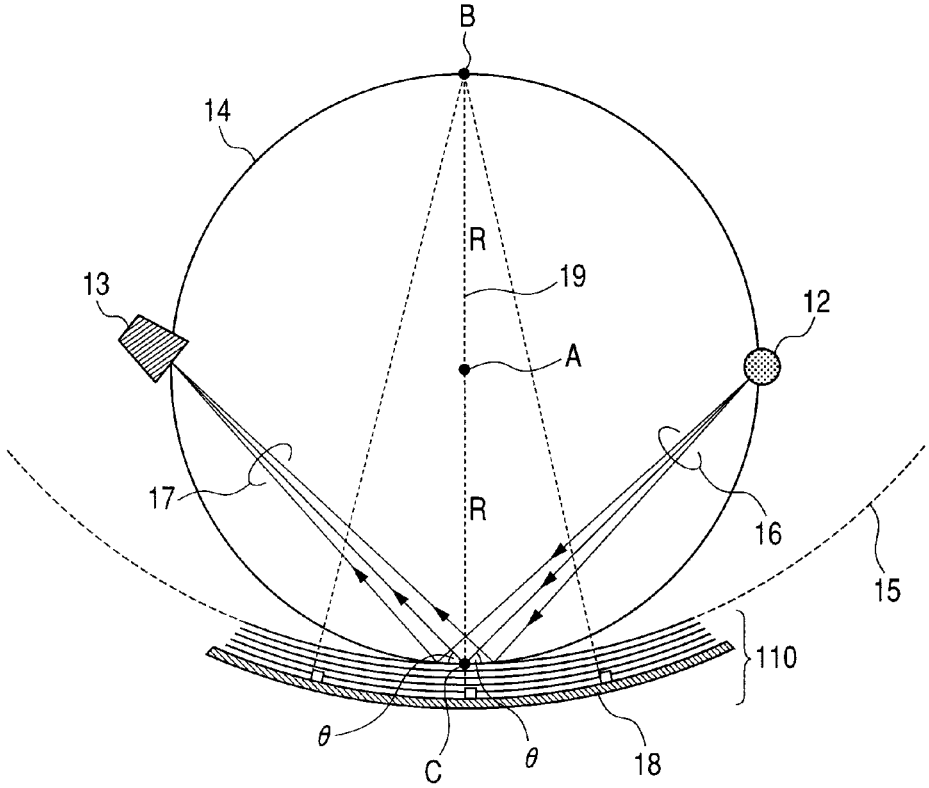
FIG. 6 PRIOR ART
FIG. 6 is a schematic illustration of a known X-ray monochromator and a known X-ray spectrometer.

FIGS. 5A and 5B are a schematic illustration of porous inorganic oxide films that can be used for this embodiment. FIG. 5A is a schematic illustration of a porous inorganic oxide film having a plurality of cylindrical pores and FIG. 5B is a schematic illustration of a porous inorganic oxide film having a plurality of spherical pores. A plurality of cylindrical pores or spherical pores is laid periodically as unit structures in a stacked manner in the porous inorganic oxide film of this embodiment. The unit structures have structural periods in the normal directions of the curved concave surface of the substrate. The structural periods in the normal directions can be observed by way of a θ-2θ scanning X-ray diffraction observation with a Bragg-Brentano arrangement. Note that the plurality of cylindrical pores can extend in directions that are in parallel with the film surface and be arranged to form two-dimensional hexagonal structures, whereas the plurality of spherical pores can be arranged to form hexagonal close-packed structures.

For the purpose of this embodiment, pores (cylindrical pores and spherical pores) refer to those whose insides are void and whose outer walls are covered by an inorganic oxide. While some of the pores may shrink during the manufacturing process as the film contracts, the pores (the cylindrical pores or the spherical pores) of this embodiment can show an aspect ratio of not less than 0.30 in order to make them have a uniform structural period in the normal directions.

Figure 4:
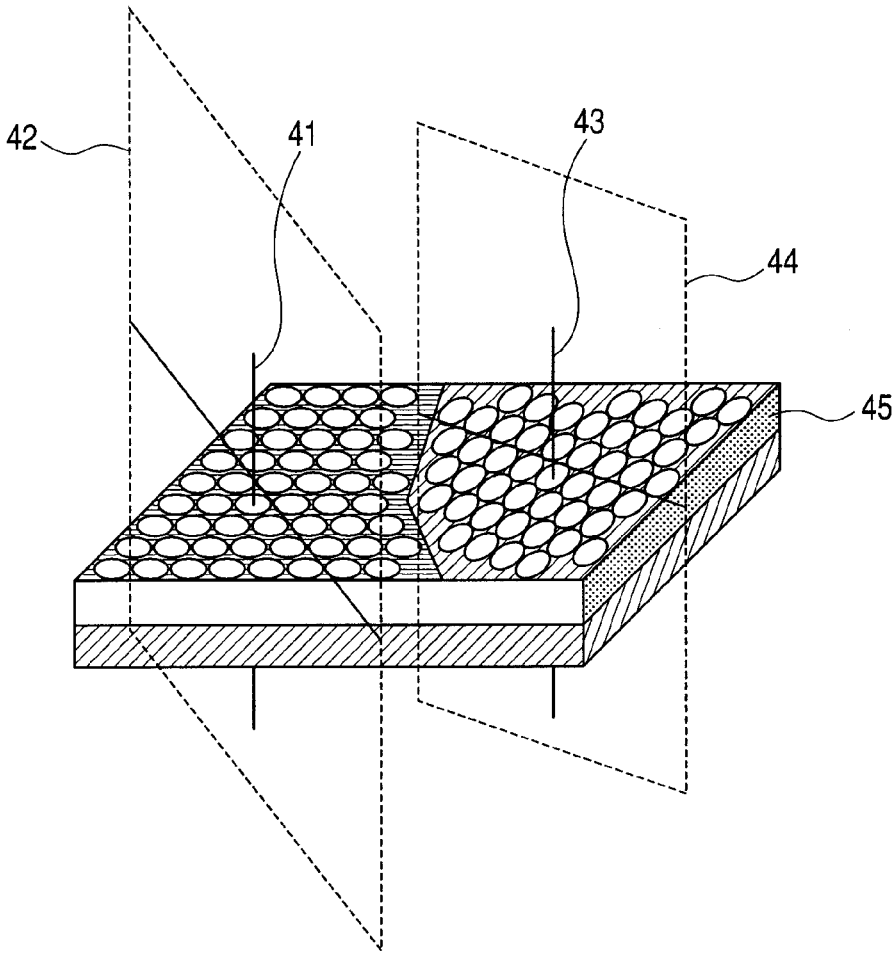
FIG. 4 is a schematic illustration of an X-ray monochromator employing a porous film having spherical pores.

FIG. 4 illustrates an X-ray monochromator formed by using a porous film having spherical pores. In the case of film 45 having spherical pores as unit structures, it is necessary that symmetric reflection plane 42 and symmetric reflection plane 44 are not parallel with each other. The symmetric reflection plane 42 is a plane that includes an axis of rotation (n=6) 41 that is perpendicular to the film surface and defined for a local porous structure existing in a certain region (the first region) of the film 45. The symmetric reflection plane 44 is a plane that includes an axis of rotation (n=6) 43 that is perpendicular to the film surface and defined for a local porous structure existing in another region (the second region) of the film 45. This means that at the time when forming a film having spherical pores as unit structures, it is formed by local porous structures in two or more than two regions in the film. Note that, if pore structures are formed in a single region as described in Japanese Patent Application Laid-Open No. 2005-246369, the film can produce cracks on the curved surface and hence it is difficult to apply such a film to an X-ray monochromator.

The porous inorganic oxide film of this embodiment can be manufactured by means of a hydrothermal method of bringing a reactive solution containing a surface active agent including an organic substances for providing templates of pores, a precursor of the inorganic component and acid into contact with the top surface of a substrate and holding it there or a process of applying a solution containing a surface active agent, a precursor of an inorganic oxide, acid and a solvent onto a substrate so as to cause an organic-inorganic complex film to be formed while the solvent evaporates. A technique of spin coating or dip coating may be employed for applying the solution (reactive solution).

To obtain a porous film, the organic substance is removed from a film prepared in the above-described manner to produce pores in the parts where the organic substance existed. The organic substance can be removed by any known means. For example, a technique of baking the film in an oxygen atmosphere, a technique of extracting the organic substance by means of a solvent or a technique of ozone oxidation may be employed. While a baking process is generally employed, a process of extraction by solvent or ozone oxidation may alternatively be adopted to remove the organic substance when it is not allowed to expose the film and the substrate to high temperatures at the time of baking.

A porous inorganic oxide film that can be used for this embodiment may be a film where the organic substance remains in the insides of (some of) the pores formed in the inorganic oxide or a porous film from which the organic substance has been completely removed so long as it can provide the required function of an X-ray monochromator. When the structural periods in the normal directions are reduced as the porous film contracts in the normal directions of the top surface of the substrate as a result of removal of the organic substance, the structural periods in the normal directions can be adjusted by selecting an appropriate process for removing the organic substance in terms of baking temperature so as to accommodate the X-ray wavelength region that is the object of spectrometering.

A porous inorganic oxide film to be used for this embodiment can be formed by way of a relatively short process of applying a precursor solution onto a substrate. Thus, the manufacturing time can be reduced so that an X-ray monochromator can be provided at low cost. Furthermore, a porous inorganic oxide film to be used for this embodiment can be prepared by way of a wet process as described above unlike artificial multilayer films that are generally prepared by way of a dry process, so that an X-ray monochromator can be provided in an easy manner without requiring any accurate process control.

Inorganic oxides that can be used for the multiple inorganic oxide film of this embodiment include silica, titania and zirconia, although they are not subjected to any particular limitations so long as they can form a porous film. A material having a low electron density can be employed from the viewpoint of X-ray wavelength resolution so long as the inorganic oxides serves to detect reflected X-rays with a sufficient intensity. For example, the X-ray wavelength resolution can be improved by using silica.

Additionally, since the porous film of the X-ray monochromator of this embodiment is formed by using an inorganic oxide, the porous film is free from the fear of degradation of spectroscopic performance of X-rays due to oxidation/degradation that arises as a result of X-ray irradiations. Thus, the present invention can provide a stable X-ray monochromator.

Organic substances for providing templates of pores for forming a porous inorganic oxide film for this embodiment are not subjected to any particular limitations so long as they can form a film for the purpose of this embodiment. Examples of such organic substances include amphiphilic molecules such as those of surface active agents. When the organic substance to be used is appropriately selected, the sizes of the aggregates of the organic substance in the film can be controlled to control the structural periods in the normal directions of the film. For example, if a nonionic surface active agent containing polyethylene oxide as hydrophilic part is employed for organic molecules, the structural periods in the normal directions of the film increase as the chain length of the polyethylene oxide increases. Thus, the structural periods in the normal directions can be adjusted by selecting appropriate organic molecules according to the X-ray wavelength region that is the object of spectroscopy.

Materials that can be used for the substrate are not subjected to any particular limitations, for example, including glass, so long as the materials are not damaged in the process of preparing the film.

Figure 2:
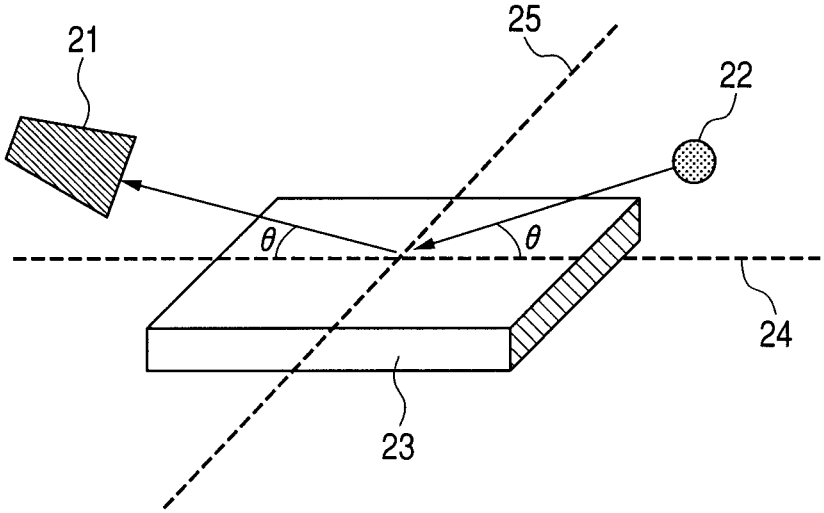
FIG. 2 is a schematic illustration of a substrate to be used for an X-ray monochromator.

In this embodiment, the profile of the top surface of the substrate is a curved concave surface with a radius of curvature equal to the diameter of the Rowland circle. In FIG. 2, the concave surface that defines the profile of the top surface of the substrate 23 can be curved in the direction of the axis 24 of the cross section along which the X-ray source 22 and the X-ray detector 21 are arranged. If the concave surface is curved also in the direction of axis 25 that is perpendicular to the cross section, X-rays can be detected with a higher intensity. Note that the X-ray monochromator is referred to as cylindrically curved monochromator when the X-ray monochromator is formed on the top surface of the concave surface that is curved only in the direction of the axis 24, whereas the X-ray monochromator is referred to as spherically curved monochromator when the X-ray monochromator is formed on the top surface of the concave surface that is curved in both the direction of the axis 24 and the direction of the axis 25.

The top surface of the substrate is a surface where the film is formed and can be subjected to a surface treatment in order to improve the wettability of the reactive solution so as to prepare a uniform and smooth film. When, for example, a hydrophilic reactive solution is employed, the organic substance on the surface may be removed typically by ozone asking in order to make the top surface of the substrate hydrophilic. Note that the film on the concave surface can produce cracks when the top surface of the substrate is subjected to a rubbing process particularly if the film has spherical pores.

The characteristics of an X-ray monochromator formed by using a porous film having cylindrical pores (porous film with cylindrical pores) and those of an X-ray monochromator formed by using a porous film having spherical pores (porous film with spherical pores) will be described below. It recommended to select an X-ray monochromator having an appropriate film by considering these characters and the specifications of the X-ray monochromator that is required for an X-ray spectrometer (the size of the monochromator, the diameter of the Rowland circle, the wavelength range, the wavelength resolution and the X-ray reflection intensity and so on).

Table 1 shows the characteristics of porous films having cylindrical pores and those of porous films having spherical pores. The X-ray reflection intensity, the X-ray wavelength resolution and so on are determined in a complex manner by these characteristics.

TABLE 1

| | Characteristics |
|---|---|
| Porous film with cylindrical pores | The electron density of the pores (voids) is smaller than those of organic substances to provide an excellent X-ray wavelength resolution.<br>The content ratio of the inorganic oxide is lower than that of a porous film with spherical pores to occasionally limit the X-ray reflectance.<br>The X-ray reflectance and the X-ray wavelength resolution are excellent because no layered structure defect arises. |
| Porous film with spherical pores | The electron density of the pores (voids) is smaller than those of organic substances to provide an excellent X-ray wavelength resolution.<br>The content ratio of the inorganic oxide is high to provide a high X-ray reflectance.<br>A layered structure defect can appear and the X-ray reflectance and the X-ray wavelength resolution can be limited. |

Now, an X-ray spectrometer formed by using this embodiment of X-ray monochromator will be described below.

The X-ray spectrometer of this embodiment is characterized by including this embodiment of X-ray monochromator, an X-ray source and an X-ray detector.

In the X-ray spectrometer, an X-ray source 12, an X-ray detector 13 and an X-ray monochromator 11 are arranged in a manner as illustrated in FIG. 1. As the incident angle of the incident X-ray from the X-ray source at reflection point C and the reflection angle θ of the reflected X-ray toward the X-ray detector are interlocked for scanning, an X-ray having a wavelength satisfying the Bragg condition (formula 1) is observed by the X-ray detector.

When the wavelengths of X-rays are relatively long, X-rays can be absorbed and/or scattered by the gas in the spectrometer depending on the optical path lengths of X-rays. Therefore, the parts where the X-ray source, the X-ray detector and the X-ray monochromator are arranged can be covered by a chamber and the internal pressure can be reduced.

While this embodiment is described below by low of examples, this embodiment is by no means limited to the examples.

Example 1

In this example, a cylindrically curved monochromator of a porous film having cylindrical pores is prepared by applying a reactive solution containing a surface active agent and a silica precursor onto a substrate.

Figure 3:
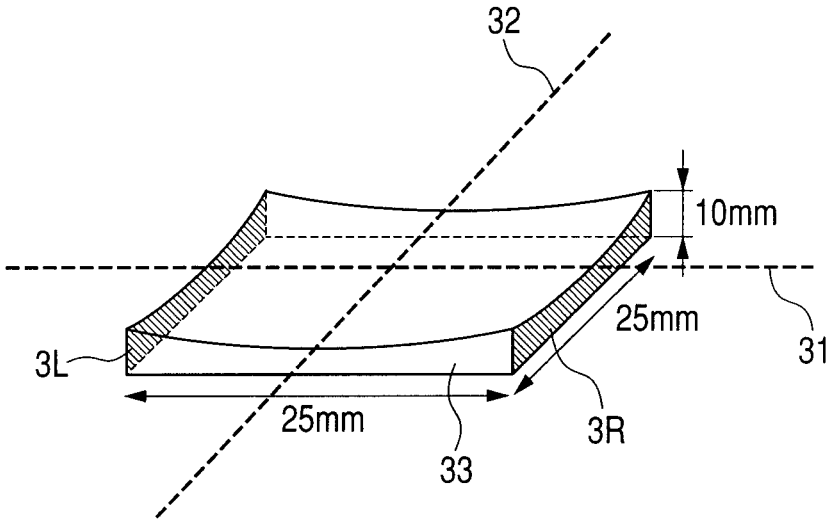
FIG. 3 is a schematic illustration of the substrate that is employed in Examples and Comparative Examples of the present invention.

Firstly, a glass substrate 33 having a curved concave surface as illustrated in FIG. 3 (length: 25 mm, width: 25 mm, height: 10 mm) is prepared. The curved surface of the substrate is spherically curved with a radius of curvature of 200 mm (equal to the diameter of the Rowland circle) in the direction of axis 31. The glass substrate is washed with acetone, isopropyl alcohol and pure ware and the surface of the substrate is cleaned in an ozone cleaning apparatus.

A reactive solution for preparing a porous film having cylindrical pores is prepared. 22.9 g of polyethylene oxide 10 hexadecyl ether is dissolved in 900 mL of isopropyl alcohol, while being stirred, and 28 mL of hydrochloric acid (0.1 M), 35 mL of ultrapure water and 156 mL of tetraethoxysilane are added thereto to prepare a reactive solution. The reactive solution is held to room temperature for 2 hours while the reactive solution is being stirred.

The glass substrate 33 is immersed in the reactive solution with the surface 3R thereof illustrated in FIG. 3 facing downward and then pulled up at a rate of 2 mm/second from the side of the surface 3L to dip coat the substrate with the reactive solution. After the dip coating, the substrate is put in a thermo-hygrostat chamber at 20° C. and RH 40% and held there for a day to age the film so as to be used as X-ray monochromator. When the formed film is partly peeled off and observed under an electronic microscope, it can be confirmed that the film is a porous film with cylindrical pores.

When the prepared X-ray monochromator is analyzed by way of a θ-2θ scanning X-ray diffraction observation with a Bragg-Brentano arrangement, using an X-ray microbeam (3 μmϕ, 8 keV), a diffraction peak indicating that the structural period in the normal direction is 5.24 nm at each position of films can be confirmed.

The X-ray monochromator is introduced into an electric furnace and the temperature is raised at a rate of 2° C./minute until the temperature gets to 400° C. When the temperature gets to 400° C., the X-ray monochromator is held to that temperature for 10 hours and then the temperature is lowered at a rate of 2° C./minute until the temperature gets to room temperature. After the baking, the monochromator is analyzed by way of a θ-2θ scanning X-ray diffraction observation with a Bragg-Brentano arrangement, using an X-ray microbeam (3 μmϕ, 8 keV), it can be confirmed that the structural period in the normal direction is contracted to 3.33 nm at each position of films. Additionally, it can be confirmed that the organic substance is removed from the X-ray monochromator by means of an infrared absorption spectrum.

An X-ray source 12 (fluorescent X-rays from a sample containing carbon, nitrogen and hydrogen respectively by 30%, 10% and 60%), an X-ray detector 13 and the prepared X-ray monochromator 11 are arranged on a Rowland circle with a radius of 100 nm as illustrated in FIG. 1 to prepare an X-ray spectrometer by interlocking the X-ray source 12 and the X-ray detector 13. The part of the Rowland circle is covered by a vacuum chamber and the sample is observed under reduced pressure. As θ is scanned within a range between 15° and 45°, an X-ray spectrum can be observed in a wavelength range between 1.72 nm and 4.71 nm. Additionally, X-rays specific to carbon and those specific to nitrogen can be observed at θ=42.2° and 28.3° respectively. The X-ray wavelength resolution is 0.035 nm at half width.

Example 2

In this example, a cylindrically curved monochromator of a porous film having spherical pores is prepared by applying a reactive solution containing a surface active agent and a silica precursor onto a substrate.

Firstly, a glass substrate 33 having a curved concave surface as illustrated in FIG. 3 (length: 25 mm, width: 25 mm, height: 10 mm) is prepared. The curved concave surface of the substrate is spherically curved with a radius of curvature of 200 mm (equal to the diameter of the Rowland circle) in the direction of axis 31. The glass substrate is washed with acetone, isopropyl alcohol and pure ware and the surface of the substrate is cleaned in an ozone cleaning apparatus.

A reactive solution for preparing structure films is prepared. 27.5 g of polyethylene oxide 10 hexadecyl ether is dissolved in 500 mL of ethanol, while being stirred, and 25 mL of hydrochloric acid (0.1 M), 25 mL of ultrapure water and 112 mL of tetraethoxysilane are added thereto to prepare a reactive solution. The reactive solution is held to room temperature for 2 hours while the reactive solution is being stirred.

The glass substrate 33 is immersed in the reactive solution with the surface 3R thereof illustrated in FIG. 3 facing downward and then pulled up at a rate of 2 mm/second from the side of the surface 3L to dip coat the substrate with the reactive solution. After the dip coating, the substrate is put in a thermo-hygrostat chamber at 20° C. and RH 40% and held there for a day so as to be used as X-ray monochromator. When the formed film is partly peeled off and observed under an electronic microscope, it can be confirmed that the formed film is a spherical pore porous film. Further, when a cross section thereof is observed under an electronic microscope, it can be confirmed that a plurality of spherical pores is arranged to form hexagonal close-packed structures.

When analyzed by way of a θ-2θ scanning X-ray diffraction observation with a Bragg-Brentano arrangement, using an X-ray microbeam (3 μmϕ, 8 keV), a diffraction peak indicating that the structural period in the normal direction is 5.65 nm at each position can be confirmed. Additionally, a diffraction pattern can be detected, if weak, in in-plane directions of a porous of films prepared on a silicon wafer plane under similar experimental conditions by a $\phi$-$2\theta_X$ scanning X-ray diffraction observation (X-ray incident angle: 0.2°) and no remarkable peak can be found on the rocking curve as a result of ϕ scanning at the position ($2\theta_X$=1.23°) where the diffraction pattern is detected. This means that a plurality of local pore structures with different symmetric reflection planes exist in a spherical pore silica porous film prepared under these experimental conditions.

The X-ray monochromator is introduced into an electric furnace and the temperature is raised at a rate of 2° C./minute until the temperature gets to 550° C. When the temperature gets to 550° C., the X-ray monochromator is held to that temperature for 10 hours and then the temperature is lowered at a rate of 2° C./minute until the temperature gets to room temperature. After the baking, the monochromator is analyzed by way of a θ-2θ scanning X-ray diffraction observation with a Bragg-Brentano arrangement, using an X-ray microbeam (3 μmϕ, 8 keV), it can be confirmed that the structural period in the normal direction is 4.26 nm at each position of films. Additionally, it can be confirmed that the organic substance is removed from the X-ray monochromator by means of an infrared absorption spectrum or the like.

An X-ray source 12 (fluorescent X-rays from a sample containing carbon, nitrogen and hydrogen respectively by 30%, 10% and 60%), an X-ray detector 13 and the prepared X-ray monochromator 11 are arranged on a Rowland circle with a radius of 100 nm as illustrated in FIG. 1 to prepare an X-ray spectrometer by interlocking the X-ray source 12 and the X-ray detector 13. The part of the Rowland circle is covered by a vacuum chamber and the sample is observed under reduced pressure. As θ is scanned within a range between 15° and 45°, an X-ray spectrum can be observed in a wavelength range between 2.21 nm and 6.02 nm. Additionally, X-rays specific to carbon and those specific to nitrogen can be observed at θ=31.6° and 21.8° respectively. The X-ray wavelength resolution is 0.048 nm at half width.

Comparative Example 1

In this comparative example, a spherically curved monochromator is prepared by using synthetic mica and the performance thereof is examined.

Firstly, a glass substrate 33 having a curved concave surface as illustrated in FIG. 3 (length: 25 mm, width: 25 mm, height: 10 mm) is prepared. The curved concave surface of the substrate is spherically curved with a radius of curvature of 200 mm (equal to the diameter of the Rowland circle) in the two directions of axis 31 and axis 32. The glass substrate is washed with acetone, isopropyl alcohol and pure ware and the surface of the substrate is cleaned in an ozone cleaning apparatus.

Then, a coating solution to be applied to the substance is prepared. 10 g of synthetic mica sodium taeniolite is added to 50 mL of n-butylamine hydrochloride solution (0.4 M) and the solution is stirred for 2 hours. After being washed for several times with purified water and subjected to a starring process, 200 mL of aqueous solution of polyoxyethylene lauryl amine hydrochloride (5 wt %) is added and subjected to an ion exchange process for 24 hours. The obtained suspension is dehydrated under reduced pressure by means of a Büchner funnel and washed for several times with purified water. The washed product is dried at 80° C., put into benzene and dispersed by means of a homogenizer. The benzene suspension is applied to the above substrate and dried firstly at room temperature and subsequently at 110° C.

When the prepared X-ray monochromator is analyzed by way of a θ-2θ scanning X-ray diffraction observation, using an X-ray microbeam (3 μmϕ, 8 keV), it can be confirmed that the structural period in the normal direction is 3.48 nm at each position of films. It can also be found by means of a contact surface profilometer that the surface coarseness of the film is 850 nm at maximum height Ry.

Then, an X-ray source 12 (fluorescent X-rays from a sample containing carbon, nitrogen and hydrogen respectively by 30%, 10% and 60%), an X-ray detector 13 and the prepared X-ray monochromator 11 are arranged on a Rowland circle with a radius of 100 nm as illustrated in FIG. 1 to prepare an X-ray spectrometer by interlocking the X-ray source 12 and the X-ray detector 13. The part of the Rowland circle is covered by a vacuum chamber and the sample is observed under reduced pressure. As θ is scanned within a range between 15° and 45°, an X-ray spectrum can be observed in a wavelength range between 1.80 nm and 4.92 nm. Additionally, X-rays specific to carbon and those specific to nitrogen can be observed at θ=40.0° and 27.0° respectively. The spectroscopic performance of the X-ray spectrometer is 0.12 nm at half width.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Applications No. 2009-272882, filed Nov. 30, 2009, No. 2010-202048, filed Sep. 9, 2010 which are hereby incorporated by reference herein in their entirety.

What is claimed is:

1. An X-ray monochromator comprising:

a substrate having a curved surface with a radius of curvature twice that of a Rowland circle; and an inorganic oxide film formed on the curved surface and having a plurality of pores, wherein the plurality of pores are laid periodically in a stacked manner in the inorganic oxide film, and have a structural period in a direction normal to the curved surface, wherein the plurality of pores are spherical, and wherein a first symmetric reflection plane includes axes of rotation (n=6) for a plurality of pores in a first region of the inorganic oxide film and is disposed perpendicular to the surface of the inorganic oxide film, and wherein a second symmetric reflection plane includes axes of rotation (n=6) for a plurality of pores in a second region of the inorganic oxide film, is disposed perpendicular to the surface of the inorganic oxide film, and is not parallel to the first symmetric reflection plane.

2. The X-ray monochromator according to claim 1, wherein the plurality of spherical pores are arranged as hexagonally close-packed structures.

3. An X-ray spectrometer comprising:

an X-ray source;

an X-ray monochromator according to claim 1; and an X-ray detector.

4. An X-ray monochromator, comprising:

a substrate having a curved surface; and an inorganic oxide film formed on the curved surface and having a plurality of cylindrical pores, each of the cylindrical pores extending parallel to the surface of the inorganic oxide film, wherein the plurality of pores are laid periodically in a stacked manner in the inorganic oxide film, and form a structure that is periodic along a direction normal to the curved surface, and wherein the radius of curvature of the curved surface is twice that of a Rowland circle.

5. An X-ray spectrometer comprising:

an X-ray source;

an X-ray monochromator according to claim 4; and an X-ray detector.

* * * * *